United States Patent [19]

Garcea

[11] 4,132,070

[45] Jan. 2, 1979

[54] POSTCOMBUSTION AIRFLOW REGULATING VALVE FOR INTERNAL COMBUSTION ENGINES

[75] Inventor: Gianpaolo Garcea, Milan, Italy

[73] Assignee: Alfa Romeo S.p.A., Milan, Italy

[21] Appl. No.: 775,533

[22] Filed: Mar. 8, 1977

[30] Foreign Application Priority Data

Mar. 12, 1976 [IT] Italy ..... 21165A/76

[51] Int. Cl.[2] ..... F01N 3/10

[52] U.S. Cl. ..... 60/290

[58] Field of Search ..... 60/290

[56] References Cited

U.S. PATENT DOCUMENTS

| | | | |
|---|---|---|---|
| 3,106,820 | 10/1963 | Schaffer | 60/290 |
| 3,868,868 | 3/1975 | Chana | 60/290 |
| 3,931,710 | 1/1976 | Hartel | 60/290 |

FOREIGN PATENT DOCUMENTS

| | | | |
|---|---|---|---|
| 2135206 | 2/1972 | Fed. Rep. of Germany | 60/290 |

*Primary Examiner*—Douglas Hart

*Attorney, Agent, or Firm*—Holman & Stern

[57] ABSTRACT

A device is disclosed which is intended to regulate the rate of flow of air injected into an exhaust-gas stream of an internal combustion engine exhaust system in order to complete post-combustion of the exhaust gas and reduce air pollution, said device being a variable-section valve which is actuated by an active member responsive to the negative pressure existing in the air-induction duct of the engine. An alternative embodiment is also disclosed in which means are provided to make the adjustment finer. Excessive cooling of the exhaust gas stream is avoided and the efficiency of the exhaust system in general is improved, including the case in which catalytic mufflers are adopted.

3 Claims; 3 Drawing Figures

POSTCOMBUSTION AIRFLOW REGULATING VALVE FOR INTERNAL COMBUSTION ENGINES

In the last years, in order essentially to minimize the emissions of unburned gases from the exhaust of internal combustion engines, the use of an air pump to blow in the exhaust ducts the air necessary to thermal or catalytic post-combustion has experienced an evergrowing diffusion: the thermal postcombustion, as is known, can take place either in the exhaust manifold or in a special thermal reactor to be inserted in the exhaust system. Catalytic post-combustion can take place, conversely, only if a catalytic reactor is purposely inserted in the exhaust system.

Such an air pump is generally a metering pump and is driven by the engine, so that its number of revolutions, $n_p$, is proportional to the number of revolutions, n, of the engine.

$$n_p = r \cdot n \quad (1)$$

wherein $r$ is the driving ratio of the pump relatively to the engine.

If $C_p$ is the piston displacement volume of the pump, $\eta_p$ is its volumetric efficiency and $\gamma_a$ is the specific gravity of the drawn-in air, the rate of flow in weight units of air delivered by the pump is:

$$Q_p = \gamma_a \cdot \eta_p \cdot C_p \cdot r \cdot n \quad (2)$$

The rate of flow in weight units of the exhaust gases, $Q_g$, into which the postcombustion air is blown, can be evaluated, as is known, as a function of the rate of flow in weight units of the air-drawn-in by the engine, $Q_a$, and of the ratio, $\lambda$, between said rate of flow $Q_a$ and the rate of flow in weight units of fuel admixed with air, $Q_b$ :

$$Q_g = Q_a \cdot (\lambda + 1/\lambda \quad (3)$$

As is known, the rate of flow in weight units $Q_a$ of the air drawn-in by a four-stroke reciprocating engine can be expressed, approximately, by the formula:

$$Q_a = \gamma_a \cdot \eta_a \cdot C \cdot n/2 \quad (4)$$

in which $\gamma_a$ is the specific gravity of the atmospherical air, $\eta_a$ is the filling efficiency of the engine in a particular condition of use ( $\eta_a$ is a function of the specific gravity drop as undergone by the drawn-in air, especially when it flows through the throttling butterfly) $C_m$ is the overall piston displacement of the engine and n, as aforesaid, is its number of revolutions. By employing the relationships (2), (3) and (4), the ratio, R, between the rate of flow delivered by the pump and the rate of flow of the exhaust gases is given by:

$$R = C_p \cdot r/C_m \cdot 2\,\lambda/\lambda + 1 \cdot \eta_p/\eta_a \quad (5)$$

Among the several magnitude appearing in the second portion of the equation (5) $C_p$, $C_m$ and r are constant, $\eta_p$ can also be taken as a constant, but also the second fraction in the second portion can be kept as a constant in a rough approximation since the mixing ratio, $\lambda$ cannot diverge too much from the stoichiometrical value of 15. The value of the ratio R thus varies only because it is inversely proportional to the filling efficiency of the engine, $\eta_a$; if the latter coefficient varies (for example) from a minimum value of 0.2 and a maximum value of 1, R will vary consistently with the throttling, between a maximum value (an engine which is severely throttled) and a minimum value which is five times smaller.

These considerations suggest that, if the rate of flow of air is the one which is necessary (to the ends of the postcombustion of the unburned fractions of the exhaust gases) when the throttle is open or nearly so, the rate of flow is exceedingly high when the engine is throttled or severely throttled. The excess air, in the first place, originates an undesirable cooling of the gas and air mixture (that which makes the postcombustion harder); but, when a catalyst is inserted in the exhaust system, it originates the formation of sulfates in the catalyst (sulfur is always present in not negligible amount in the crude and refined fuels).

In connection with these drawbacks in the air-delivery system referred to above, the advisability has recently been indicated of adjusting the rate of flow of the air to be blow-in into the exhaust gases stream so as to make the rate of flow of air, as far as practicable, always proportional to the rate of flow of such exhaust gases, in such a way that the ratio R between the respective rates of flow is, as far as practicable, constant and not variable (consistently with equation (5) ), contrary to what has been described above.

The device according to the present invention aims just at automatically maintaining constant the value of R throughout the entire field of practical use or, also, at having it to vary, but according to a law of variation which is consonant with the requirements of the postcombustion, and thus sharply different from that expressed by the equation (5).

The device in question is based on the idea of deflacting and discharging into the atmosphere the excess rate of flow of air of the pump: it is characterized, however, essentially by the special system for the regulation of the rate of flow of the deflected air stream, a system which permits just to keep constant the ratio R of the rate of flow of the blow-in air to the rate of flow of the exhaust gases, or at least to have such a ratio varying according to an appropriate law of variation, the system being based on the considerations which stem from the following theoretical concepts.

In the drawings, FIG. 1 is a schematic diagram of a secondary air supply system designating pressure and flow quantities for analysis.

Figure 1:
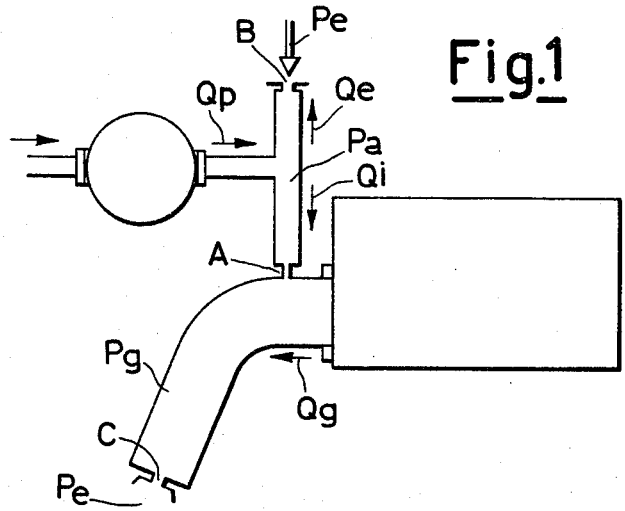

With reference to the FIG. 1 of the accompanying drawings, A indicates the area of a restricted cross-section through which the rate of flow of the blown-in air passes, $Q_i$ (A is thus the equivalent port area which takes into account, essentially, the flow passage areas through the air-blowing nozzles into the exhaust manifold), B indicates the area of a restricted cross-section area through which the rate of flow of air, $Q_e$, deflected towards the atmosphere passes (this is the area B which must be regulated in a particular embodiment of the device: in an alternative embodiment also the area A can be regulated simultaneously); C is the area of a theoretical flow passage cross-sectional area through which the $Q_g$ rate of flow of the exhaust gases passes with the rate of flow $Q_i$ of the blown-in area (admixed with the exhaust gases), said area C being characterized in that the turbulent pressure drop through it equals the exhaust back pressure, that is, the pressure drop the gases undergo when flowing through the exhaust system (conduits, silencing mufflers, possible catalytic muffler and so on).

With reference to the diagram of FIG. 1, if $p_a$ is the pressure existing downstream of the pump, $p_g$ the pressure in the manifold, $p_e$ the external pressure, and if $K_A$, $K_B$ and $K_C$ are constants which essentially depend from the outflow coefficients of the ports A, B and C, the following relationship hold good :

$$p_a - p_e = K_B \frac{Q_e^2}{B^2} \tag{6}$$

$$p_a - p_g = K_A \frac{Q_i^2}{A^2} \tag{7}$$

$$p_g - P_e = K_C \frac{(Q_i + Q_g)^2}{C^2} \tag{8}$$

Inasmuch as it is:

$$R = \frac{Q_i}{Q_g} \tag{8'}$$

$$P_g - P_e = K_C \cdot (1 + R)^2 \frac{Q_g^2}{C^2} \tag{9}$$

$$P_g = P_e + K_C \cdot (1 + R)^2 \frac{Q_g^2}{C^2} \tag{9'}$$

from (7) and (9'):

$$p_a - p_e - K_C \cdot (1 + R)^2 \cdot \frac{Q_g^2}{C^2} = K_A \frac{Q_i^2}{A^2} \tag{10}$$

$$p_a - p_e = K_A \frac{Q_i^2}{A^2} + K_C \cdot (1 + R)^2 \cdot \frac{Q_g^2}{C^2} \tag{11}$$

from (8') and (11) it is:

$$p_a - p_e = K_A \frac{Q_i^2}{A^2} + K_C \cdot \frac{(1 + R)^2}{R^2} \cdot \frac{Q_i^2}{C^2} \tag{12}$$

$$p_a - p_e = \left[ K_A/A^2 + K_C/C^2 \cdot \frac{(1 + R)^2}{R^2} \right] Q_i^2 \tag{13}$$

$$Q_i = \frac{\sqrt{p_a - p_e}}{\sqrt{K_A/A^2 + K_C/C^2 \cdot \frac{(1 + R)^2}{R^2}}} \tag{14}$$

Formula (6) now gives:

$$Q_e = \frac{\sqrt{p_a - p_e}}{\sqrt{K_B/B^2}} \tag{15}$$

From (14) and (15) it is:

$$\frac{Q_i}{Q_2} = \frac{\sqrt{K_B/B^2}}{\sqrt{K_A/A^2 + K_C/C^2 \cdot \frac{(1 + R)^2}{R^2}}} \tag{16}$$

If the fraction in the second portion of equation (16) is called F, it is :

$$Q_e = Q_i/F \tag{17}$$

Inasmuch as :

$$Q_i + Q_e = Q_P \tag{18}$$

on taking account of (17) it is:

$$Q_i (1 + 1/F) = Q_P \tag{19}$$

$$Q_i = Q_P \cdot F/(F + 1) \tag{20}$$

and, on taking account of (2) it is:

$$Q_i = F/(F + 1) \cdot \gamma_a \cdot \eta_P \cdot C_p \cdot r \cdot n \tag{21}$$

On the other hand, due to (3) and (4), it is:

$$Q_g = (\lambda + 1)/\lambda \cdot \gamma_a \cdot \eta_a \cdot C_m \cdot n/2 \tag{22}$$

Therefore, due to the relationship (21) and (22), the ratio R between $Q_i$ and $Q_g$ becomes:

$$R = \frac{F}{F + 1} \cdot \frac{\lambda}{\lambda + 1} \cdot \frac{\eta_p}{\eta_a} \cdot \frac{C_p}{C_m} \cdot 2r \tag{23}$$

It can be observed that, with the exception of the term $\eta_a$, (filling efficiency of the engine) and of F, all the other terms in the second portion of the equation above are constants which depend from the engine design, or which can be so assumed with a satisfactory approximation (for example, the mixture ratio is not very far from the stoichiometrical value and the volumetric efficiency of the pump can also be assumed as being constant in the zone of interest of the field of practical use).

In the term F, which, due to the assumption made can be written $$F = \frac{1}{B} \sqrt{\frac{K_B}{K_A/A^2 + K_C/C^2 \cdot \frac{(1 + R)^2}{R^2}}} \tag{24}$$

the value of C is a constant. In a particular embodiment of the device also A is a constant and constant can also be assumed to be the outflow coefficients $K_A$, $K_B$, $K_C$. The result is that the relationship (23), on taking into account (24) can be regarded as an equation which, for each value of $\eta_a$ gives the value of the port area B which is required to obtain a certain value of R. In addition, it can be inferred from (23) on account of (21) and (22) from which (23) is taken, that for a certain fixed value of $\eta_a$ (and the fixed value of the port area B consistently), R remains constant as the number of revolutions is varied. Obviously, if, in another version of the device, also the value of A is varied, equation (23) permits to obtain the values of B for every one of the values allotted to A. In this way, with such a version of the device, in the case in which wide variations of regulation are desired for the post-combustion air flow, more suitable design solutions can be obtained relative to the case in which the port area A is a constant.

In the particular version of the device proposed herein (which has been indicated first) the value of the port area B depends, in one of the possible embodiments of the device in question, from the position taken by a frusto-conical member having a shaped generating line which is coaxial with a calibrated bore. The axial position of the conical member is defined by the fact that the member itself is integral with a diaphragm on which the negative pressure $\Delta_p$ existing at the intake side of the engine is active and is biased by a spring. The filling efficiency $\eta_a$ of the engine, as is known, is a function of the absolute pressure $p_{al}$ which exists in the feed conduit, according to the following relationship, in which K is a constant:

$$\eta_a = K \cdot p_{al} \quad (25)$$

so that on account of the fact that $p_{al} = p_e - \Delta_p$, it is:

$$\eta_a = K \cdot (p_e - \Delta_p) \quad (26)$$

On the basis of the diameter of the diaphragm and the characteristics of the biasing spring at each value of $\Delta_p$, that is of $\eta_a$, there is a position of the cone relative to the calibrated bore. In the proposed device the cone can be so shaped as to maintain R a constant as $\eta_a$ is varied, or so as to have R varying in accordance with an appropriate law of variation.

According to another version of the device (the second named above) also the port area A can be varied concurrently with the port area B, since, for example, also the port A is defined by a fixed bore relative to which a coaxial shaped member is moved by the same diaphragm on which the negative pressure $\Delta_p$ is active.

Figure 2:
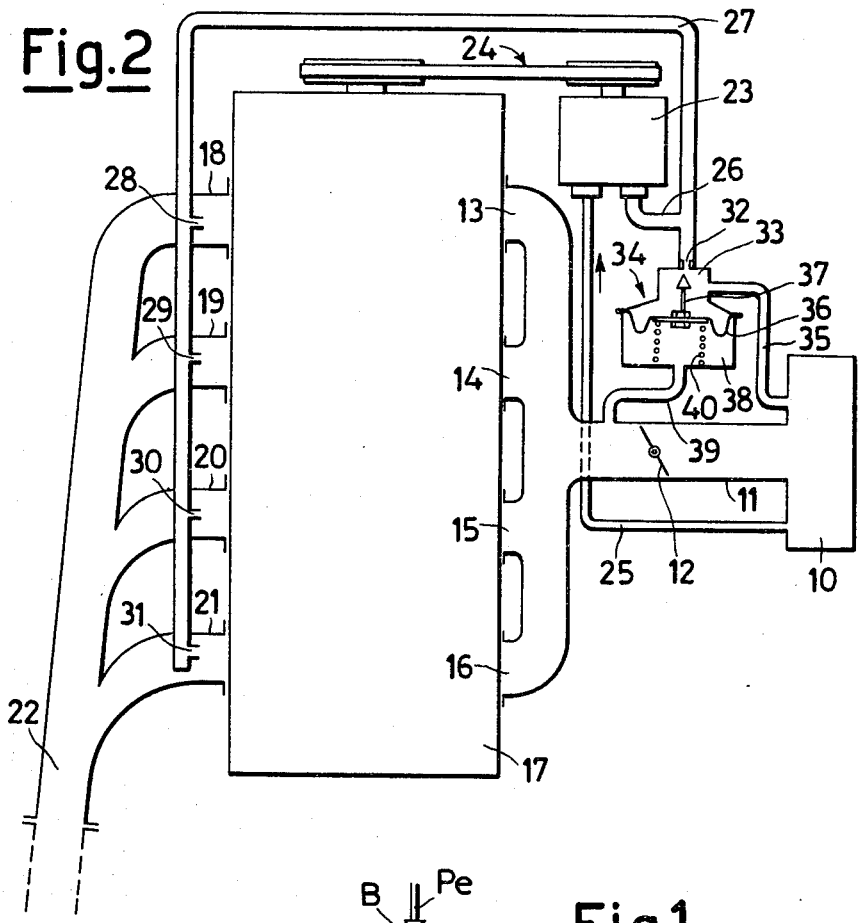
FIG. 2 is a schematic diagram of a first embodiment of the invention in which only port B is variable.
Figure 3:
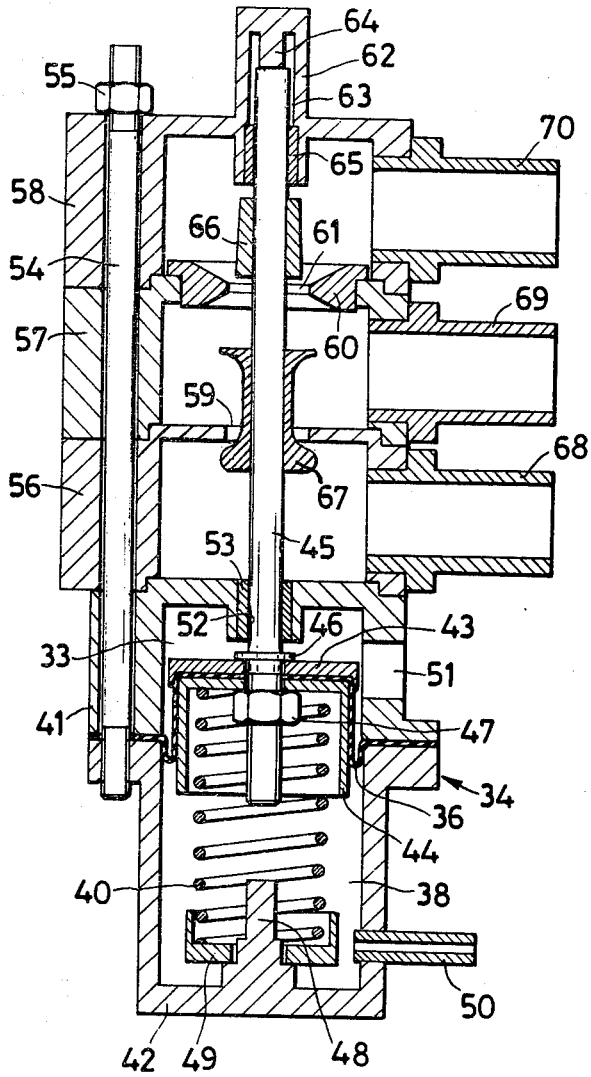
FIG. 3 shows a secondary air control valve for a second embodiment of the invention in which both of ports A and B are variable.

Features and advantages in the invention can at any rate be better understood by examining FIGS. 2 and 3 of the accompanying drawings, which show by way of non-limiting example only how the device can be embodied.

FIG. 2 shows at 10 an air-suction filter and 11 is the intake duct and 12 the throttling butterfly for the air intake, the air being possibly admixed with the fuel drawn in by the engine.

From the manifold 11 branch off the several ducts 13, 14, 15 and 16 which feed the engine cylinders (in the case in point these are four). The engine block is shown at 17 and at 18, 19, 20 and 21 are indicated the individual discharge ducts of the cylinders, which then merge into the single exhaust tube 22. The remaining portion of the exhaust pipe, possibly comprising post-combustion mufflers and silencing mufflers, has not been shown.

The drawings show a metering pump, indicated at 23, driven to rotation by a drive transfer mechanism as generally indicated at 24 and actuated by the engine crankshaft (not shown in the drawing).

The suction side of the pump 23 is connected, via the duct 25, to the filter 10 and its delivery side is connected, via the duct 27 and the nozzles 28, 29, 30 and 31, which open into the individual exhaust ducts of the engine, which are 18, 19, 20 and 21, respectively.

The duct 27 communicates through the variable-cross-section port 32 with a chamber 33 which, in its turn, is connected via the duct 35, to the suction filter 10. At 37 is indicated the throttling member from the position of which depends the cross-sectional flow area of the variable cross-section-port 32.

The throttling member 37 is connected to the diaphragm 36 upon which, with the intermediary of the chamber 38 and the duct 39, is active the negative pressure existing in the suction duct downstream of the butterfly 12. In the chamber 38 a spring is arranged, indicated at 40, which biases the diaphragm 36.

A portion of the air delivered by the metering pump 23 at the several revolution rates of the engine, reaches through the duct 27, to the nozzles 28, 29, 30 and 31 and is blown into the engine exhaust gases stream in order to activate the post-combustion of the exhaust gases themselves. Another portion, conversely, is discharged into the suction filter 10 through the variable-area port 32. For a certain rate of flow delivered by the pump, the fraction discharged into the filter is a function of the flow passage cross-sectional area through the port 32. This cross-section is a function of the intake negative pressure of the engine since, as outlined above, the throttling member 37 bound to the diaphragm 36 takes from time to time the several equilibrium positions consistently with the pressure differential on its two surfaces, which counteracts the bias of the spring 40.

As the rate of flow of the air drawn by the engine is increased, the rate of revolution remaining constant, and thus as the absolute feeding pressure is increased (that is, as the negative pressure in the duct 11 downstream of the throttle 12 is decreased), the diaphragm 36, which is subjected to a decreasing pressure differential, thrusts, under the bias of the spring 40, the throttling device 37 in the direction to close the port 32. Thus the flow cross-sectional area through which the air delivered by the pump 23 is discharged in the filter is being gradually reduced, and as the fraction of air discharged is decreased, the rate of flow of air which through the duct 27 reaches the nozzles 28, 29, 30 and 31 is increased and is blown into the exhaust gases stream. The rate of flow of the blown-in air can thus be increased, as the rate of flow of the air drawn in by the engine is increased. The shape of the shutter member 37 thus governs at any rate the law of variation of the cross-sectional area of the port 32 and therewith the law of variation of the rate of flow of air discharged into the filter: consequently, for a determined number of revolutions, the ratio between the rate of flow of the air blown into the exhaust gas stream and the rate of flow of the exhaust gases themselves can remain constant as the induction pressure varies, that is as the position of the butterfly varies, or it can be varied according to the most appropriate law of variation in such a way as to improve the efficiency of the post-combustion process.

Conversely, as the rate of flow of the air drawn in by the engine varies, the value of an absolute feed pressure remaining constant (thus as the rate of rotation of the engine varies), the position of the throttling device relative to the fixed port 32 remains constant (since the pressure is constant which acts upon the diaphragm 36). Under these conditions, as has been shown in the theoretical discussion above, that the ratio between the air blown into the exhaust duct and the air drawn in by the engine remains constant.

The device is thus capable of regulating the rate of flow of the post-combustion air as the rate of flow of the drawn-in air is varied through-out all the points of the field of use of the engine, that is to say, at any value of the feeding pressure and at any value of the rate of rotation of the engine.

FIG. 3 shows a preferred embodiment of the device for regulating the post-combustion air rate of flow: the component parts which have already been shown in FIG. 2 are indicated with the same reference numerals.

The casing of the diaphragm capsule 34 is made in this case with two half-shells 41 and 42 having flanges between which the peripheral edge of the diaphragm 36 is pinched. To the central portion of the diaphragm are fastened the dish 43, the cup 44 and the stalk 45 by means of the seeger 46 and the nut 47. At 48 is shown an abutment, integral with the bottom wall of the half-shell 42, which acts as a bottom end of stroke for the stalk 45. Onto the abutment 48 is slipped a cup 49 which houses the spring 40. In correspondence with the opposite end, the same spring is housed in the interior of the cup 44. In a bore of the sidewall of the half-shell 42 is affixed the fitting 50, which is to be connected to the duct 39 of FIG. 2. Thus, it established a communication between the hollow space 38 of the capsule and the induction manifold 11 downstream of the butterfly 12. A bore 51 through the sidewall of the half-shell 41 establishes a communication between the outside atmosphere and the hollow space 33 of the capsule. Possibly, the hollow space 33 can be put in communication with the intake filter of the engine as indicated at 10 in FIG. 2, and in this case the bore 51 is connected with the duct 35 of FIG. 2. The stalk 45 emerges from the capsule 34 through the bore 52 of the bottom wall of the half-shell 41. At 53 is shown a bush, inserted in the bore 52, by which the stalk 45 is slidably guided.

To the two half-shells 41 and 42 are fastened by the stud bolt 54 and the nut 55 the three half-shells 56, 57, 58 which are superposedly arranged and each centered in the bottom wall of its next half-shell. The bottom wall of the half-shell 56 has a bore indicated at 59, whereas in the bottom wall of the half-shell 57 is inserted a ferrule 60 having a bore 61, which corresponds to the port 32 of FIG. 2. The bottom wall of the half-shell 58 has a central boss indicated at 62, through which an axial bore 63 is formed. In the interior of the bore 63 an abutment, indicated at 64, is formed, which acts as a top end of stroke of the stalk 45 and a bushing 65 is also inserted, which guides the stalk 45 in the sliding motion of same. To the stalk 45 is affixed the throttling member 66 having a frustoconical shape with a shaped generating line, which engages the bore 61 (the throttling member 66 corresponds to the throttling member 37 of FIG. 2) and also the shutter 67 is affixed to the stalk 45, the shutter having the form of a spool and engaging the bore 59. To the sidewall of the half-shell 56 is fastened the fitting 68 which is connected to the conduit, indicated at 27 in FIG. 2, which carries the air dispensed by the pump to the nozzles, these being indicated at 28, 29, 30 and 31, still in FIG. 2.

To the sidewall of the half-shell 57 is fastened the fitting 69 which is connected to the delivery duct of the air pump, said duct being indicated at 26 in FIG. 2. To the sidewall of the half-shell 58 is fastened the fitting 70 which is connected to the duct, indicated at 35 in FIG. 2, which discharges the excess air which exceeds the air blown into the exhaust gases, towards the suction filter 10. The air regulating device shown in FIG. 3 operates in a manner which is similar to that shown diagrammatically in FIG. 2.

The diaphragm 36 takes a number of different positions of equilibrium consistently with the pressure differential which is active upon the surfaces of the diaphragm and which originates a force counteracting the bias of the spring 40. Inasmuch as the pressure in the chamber 33 is substantially constant and equal or near to the atmospherical pressure, the pressure differential aforementioned varies according to the pressure existing in the hollow space 38, which is the engine feeding pressure, that is, it is the negative pressure which exists in the manifold 11 down-stream of the butterfly 12.

With a strong negative pressure which corresponds to a reduced power delivery by the engine, the diaphragm 36 is displaced downwards since the bias of the spring 40 is high. With weak negative pressures which correspond to high power deliveries by the engine, the diaphragm 36 is displaced upwards, since the bias of the spring 40 is now small. With intermediate pressures, which correspond to average power deliveries by the engine, the diaphragm 36 takes intermediate positions.

Consistently, the stalk 45 is shifted downwards and upwards or it takes intermediate positions. The maximum downward stroke of both the diaphragm 36 and the stalk 45, is limited by the abutment 48, whereas their maximum upward displacement is limited by the abutment 64.

With the shutters 67 and 66 having the shape shown in FIG. 3, when the diaphragm 36 and the stalk 45 are wholly displaced downwards, (engine operating at nearly idiling rpms) the bore 59 is closed by the upper edge of the shutter 67 whereas the flow passage cross-section through the bore 61 is rather wide since in correspondence with the same bore there is the upper tapered portion of the throttling member 66. Thus the air delivered by the pump, which reaches the device through the fitting 69, is completely discharged through the port of the bore 61 and is not blown into the engine exhaust gas stream.

When, then, the diaphragm 36 and the stalk 45 are wholly shifted upwards (engine operating at high rpms), the bore 59 is still closed, now by the bottom edge of the shutter 67, whereas the flow passage area through the bore 61 is at a maximum and also in this case all the air delivered by the pump is discharged to the outside and is not blown into the engine exhaust gas stream.

For intermediate positions of the diaphragm 36 and the stalk 45 (engine working an intermediate rpms), in correspondence with the bore 59 there is the reduced portion of the shutter 67 which leaves a gap free, through which the air delivered by the pump is sent to the nozzles and blown into the exhaust gas stream. Meanwhile, in correspondence with the bore 61 there is positioned the intermediate portion of the throttling member 66 which leaves free flow passage areas of a wider surface as the negative pressures grow smaller. Correspondingly, the rate of flow of the discharged air is higher or lower and thus the rate of flow of air blown into the exhaust gas stream is smaller or higher, consistently with the rate of flow of the exhaust gases themselves.

I claim:

1. An exhaust gas post-combustion system for an internal combustion engine having an air induction duct including means for throttling the rate of drawn-in air and exhaust gas duct means, said system comprising nozzle means opening into said exhaust gas duct means for introducing air into said exhaust duct means, a metering air pump mechanically connected to the engine, a first valve assembly for receiving air from said pump and discharging a proportion thereof dependent upon the degree of opening of said first valve assembly, said first valve assembly comprising a first port and a frustoconical valve member movable with respect to said port to vary the degree of opening of said first valve assembly, a diaphragm operatively connected to said frustoconical member to control movements thereof, means for exposing one side of said diaphragm to negative pressure existing in said air induction duct downstream of said throttling means, means for exposing the opposite side of said diaphragm to pressure existing upstream of said throttling means, means biasing said diaphragm in opposition to the effect of said negative pressure whereby the degree of opening of said first valve assembly varies in accordance with variations in said negative pressure, said degree of opening increasing with increases in said negative pressure and decreasing with decreases in said negative pressure and being at a maximum when said negative pressure is at a maximum negative value, a second valve assembly for receiving air from said pump and delivering air to said nozzle means, said second assembly comprising a second port and a shutter member for said second port in the form of a spool valve operatively connected to said diaphragm, said spool valve having opposed flanges for closing said second port when said negative pressure is at maximum and minimum values respectively and said spool valve having an intermediate spool section between said flanges for opening said second port when said negative pressure is between said maximum and minimum values.

2. The system of claim 1 wherein said frusto-conical member and said spool valve are carried by a common rod connected to said diaphragm.

3. The system of claim 1 wherein said first and second valve assemblies have a common inlet chamber communicating with said pump.

* * * * *